US010378828B2

(12) United States Patent
Sun et al.

(10) Patent No.: US 10,378,828 B2
(45) Date of Patent: Aug. 13, 2019

(54) ANTI-GRAVITY HEAT PIPE DEVICE

(71) Applicant: COOLER MASTER CO., LTD., New Taipei (TW)

(72) Inventors: Chien-Hung Sun, New Taipei (TW); Tzu-Wei Gu, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 33 days.

(21) Appl. No.: 15/430,448

(22) Filed: Feb. 11, 2017

(65) Prior Publication Data

US 2017/0241717 A1 Aug. 24, 2017

Related U.S. Application Data

(60) Provisional application No. 62/297,148, filed on Feb. 19, 2016.

(30) Foreign Application Priority Data

May 5, 2016 (CN) ..... 2016 1 0292522

(51) Int. Cl.
*F28D 15/04* (2006.01)
*F28D 15/02* (2006.01)

(52) U.S. Cl.
CPC ..... *F28D 15/04* (2013.01); *F28D 15/046* (2013.01); *F28D 2015/0216* (2013.01); *F28D 2015/0225* (2013.01)

(58) Field of Classification Search
CPC ..... F28D 2015/0216; F28D 2015/0225; F28D 15/04; F28D 15/046
USPC ..... 165/104.26, 104.33
See application file for complete search history.

(56) References Cited

U.S. PATENT DOCUMENTS 7,137,442 B2 * 11/2006 Kawahara ..... F28D 15/0233 165/104.26
7,845,394 B2 * 12/2010 Chang ..... F28D 15/046 165/104.21
2007/0107878 A1 * 5/2007 Hou ..... F28D 15/025 165/104.26

FOREIGN PATENT DOCUMENTS

CN 103217038 A 7/2013
CN 205066529 U 3/2016

* cited by examiner

*Primary Examiner* — Joel M Attey
(74) *Attorney, Agent, or Firm* — Maschoff Brennan

(57) ABSTRACT

A heat pipe device includes an outer pipe and at least one first capillary structure. The outer pipe is a hollow pipe and has a defined lengthwise direction, and the first capillary structure is accommodated along the lengthwise direction and positioned in the outer pipe, and at least one steam channel is formed between the first capillary structure and the outer pipe. Even if the heat pipe device is upside down, the heat pipe still can resist gravity and work normally to achieve the effect of using the heat pipe without being limited by the using direction.

10 Claims, 7 Drawing Sheets

ANTI-GRAVITY HEAT PIPE DEVICE

FIELD OF THE INVENTION

This disclosure relates generally to heat pipes, and more particularly to a heat pipe device with an anti-gravity function.

BACKGROUND OF THE INVENTION

As the required performance of electronic devices becomes increasingly higher, the quantity of heat generated by the electronic devices is larger and larger, so that a heat sink with good heat dissipation efficiency is required.

A heat pipe playing the role of a quick heat transmitter for the heat sink is generally provided to transmit a working fluid and/or a steam back and forth in the heat pipe. Due to the influence of gravity, and the principle of hot air ascending and cold air descending, the steam naturally flows from top to bottom, and the fluid flows from top (or a higher position) to bottom (or a lower position), and the working fluid also naturally flows from top to bottom.

However, the electronic device using the heat pipe is not necessarily used, installed or placed according to the configuration of the heat pipe. For example, the heat pipe is originally set up in such a way that the heat source is situated at the lower end of the heat pipe, and a certain electronic device such as a smart phone or a flat PC generally comes with a screen rotated automatically with the direction of gravity, so that users usually use the electronic device in a transverse direction or upside down. As a result, the heat pipe in the electronic device is also upside down, and the heat source is situated at the upper end of the heat pipe. Now, the steam has difficulty resisting the gravity or flowing from top to bottom, and the condensed water liquid also has difficulty resisting the gravity or flowing from bottom to top, so that the heat transmission efficiency of the heat pipe is reduced significantly, and the heat dissipation is affected adversely.

Therefore, it is a main subject of this disclosure to overcome the aforementioned drawbacks.

SUMMARY OF THE INVENTION

In view of the aforementioned drawbacks of the prior art, it is a primary objective of the present invention to provide a heat pipe device having a cavity capable of separating liquid and gas, and the pressure of the gas is used to push the liquid to flow, so that even if an evaporation end is situated at the upper end of the heat pipe, the heat pipe still can work properly to achieve the effect of using the heat pipe without being limited by the using direction.

To achieve the aforementioned and other objectives, this disclosure provides a heat pipe device, comprising: an outer pipe, being a hollow pipe and having a defined lengthwise direction; and at least one first capillary structure, accommodated along the lengthwise direction and positioned in the outer pipe, and at least one steam channel being formed between the at least one first capillary structure and the outer pipe.

This disclosure further provides a heat pipe device, comprising: an outer pipe, being a hollow pipe and having a defined lengthwise direction; at least one first capillary structure, accommodated along the lengthwise direction and positioned in the outer pipe, and at least one steam channel being formed along the lengthwise direction and between the at least one first capillary structure and the outer pipe; and at least one inner pipe, wound around the at least one first capillary structure, and both ends of the at least one first capillary structure being exposed from both ends of the at least one inner pipe respectively and communicated to the at least one steam channel.

Compared with the prior art, this disclosure has the following effect. The heat pipe device of this disclosure can still resist gravity and work normally even when it is used in an upside down condition, so as to achieve the effect of using the heat pipe device without being limited by the using direction.

DESCRIPTION OF THE PREFERRED EMBODIMENTS

The technical contents of the present invention will become apparent with the detailed description of preferred embodiments accompanied with the illustration of related drawings as follows. It is noteworthy that the preferred embodiments are provided for illustrating this disclosure rather than restricting the scope of the disclosure.

Figure 1:
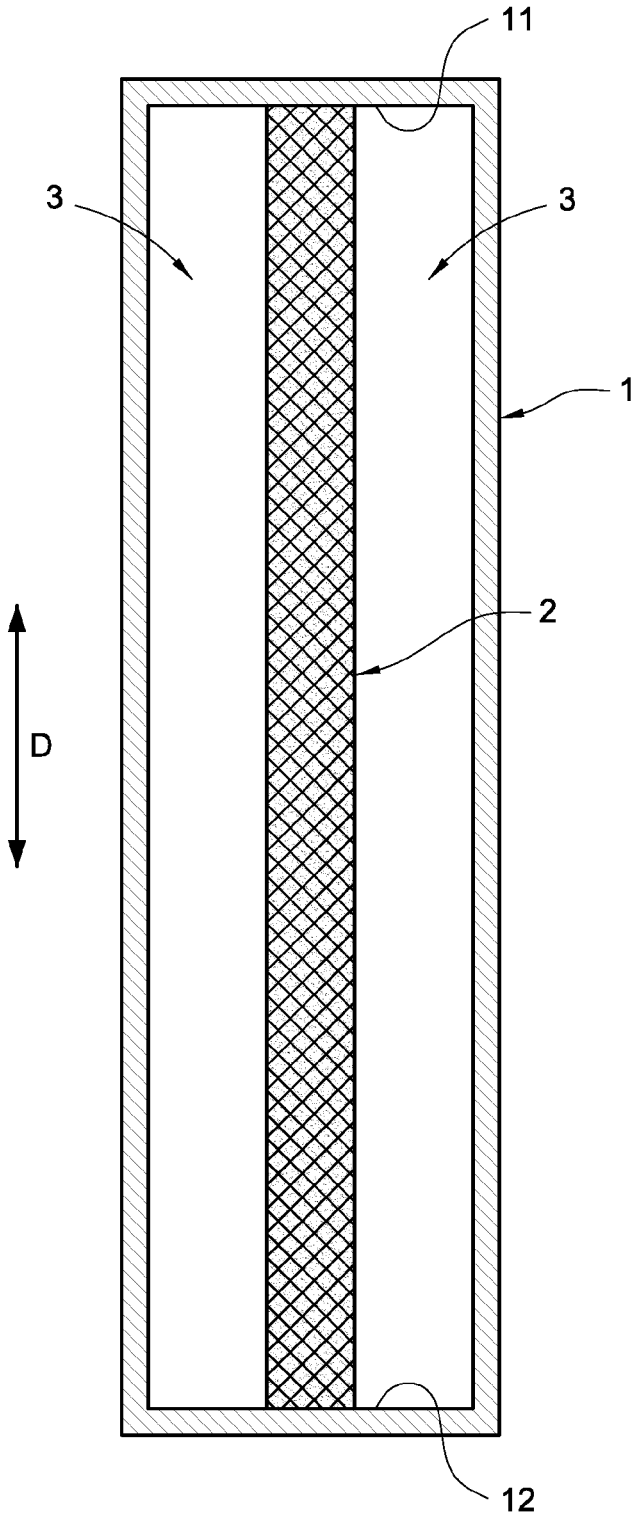
FIG. 1 is a longitudinal and cross-sectional view of a first preferred embodiment of this disclosure according to FIG. 1.
Figure 2:
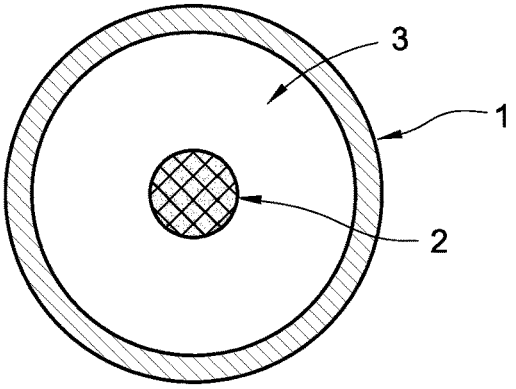
FIG. 2 is a transversal and cross-sectional view of the first preferred embodiment of this disclosure.

This disclosure provides an anti-gravity heat pipe device capable of forcing the steam to flow from top to bottom and pushing the condensed water formed after the exchange of heat from bottom to top accordingly, so as to fit the application of the electronic devices without being limited by the using direction. Refer to FIGS. 1 and 2 for the first preferred embodiment of this disclosure, FIGS. 3, 4, and 5 for the second, third and fourth preferred embodiments of this disclosure respectively, FIGS. 7 and 9 for the schematic views of the flow of steam and water in accordance with the fifth and sixth preferred embodiments of this disclosure respectively, and FIGS. 6 and 8 for the schematic views of the flow of steam and water in accordance with the fourth and fifth preferred embodiments of this disclosure respectively.

The heat pipe device in accordance with the first preferred embodiment of this disclosure as shown in FIGS. 1 and 2 comprises an outer pipe 1 and at least one first capillary structure 2, wherein the quantity of first capillary structures 2 is not limited, and this preferred embodiment uses one first capillary structure 2 to illustrate this disclosure. The outer pipe 1 is a hollow pipe and has one end and the other end opposite to each other, and one end of the outer pipe 1 to the other end of the outer pipe 1 (or the other way around) is defined as a lengthwise direction D.

The first capillary structure 2 is accommodated along the lengthwise direction D and positioned in the outer pipe 1, but the positioning method is not limited, and the following method is used to illustrate this disclosure. The outer pipe 1 has a first inner end 11 and a second inner end 12 opposite to each other, and both ends of the first capillary structure 2 are abutted against the first inner end 11 and the second inner end 12 respectively, and positioned in the outer pipe 1, so that the first capillary structure 2 can be used for transmitting water between both ends inside the outer pipe 1 quickly.

At least one steam channel 3 is formed along the lengthwise direction D and between the first capillary structure 2 and the outer pipe 1, so as to constitute the heat pipe device of the first preferred embodiment of this disclosure. Wherein, the quantity of steam channels 3 is not limited. In this preferred embodiment, the external periphery of the first capillary structure 2 and the inner wall of the outer pipe 1 are spaced apart without contact (as shown in FIG. 2) and the first capillary structure 2 is not necessarily positioned at the center of the outer pipe 1 as long as it is not contacted with the inner wall of the outer pipe 1, so that just one steam channel 3 is formed between the first capillary structure 2 and the outer pipe 1. However, if the first capillary structure 2 of a preferred embodiment is manufactured in the shape of an elliptical cylinder (not shown in the figure) instead the cylindrical shape (as shown in FIG. 2), the hollow interior of the outer pipe 1 will be partitioned to form two steam channels (not shown in the figure).

The first capillary structure 2 is a solid capillary structure, but not limited to any particular solid capillary structure. In this preferred embodiment, a powder sintered capillary structure (as shown in the figures) or a tightly bundled metal mesh capillary structure (not shown in the figure) is used for illustrating this disclosure.

Figure 3:
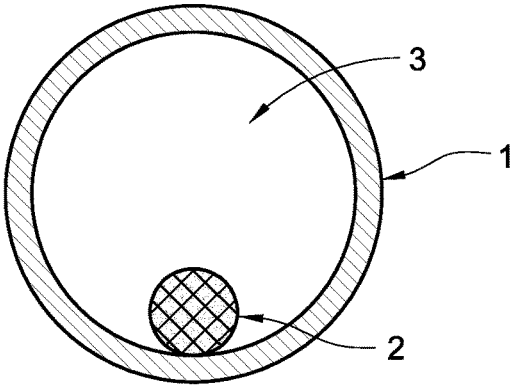
FIG. 3 is a transversal and cross-sectional view of a second preferred embodiment of this disclosure.

With reference to FIG. 3 for a heat pipe device in accordance with the second preferred embodiment of this disclosure, the second preferred embodiment is substantially the same as the first preferred embodiment except that the external periphery of the first capillary structure 2 of the second preferred embodiment is partially contacted to the inner wall of the outer pipe 1.

Figure 4:
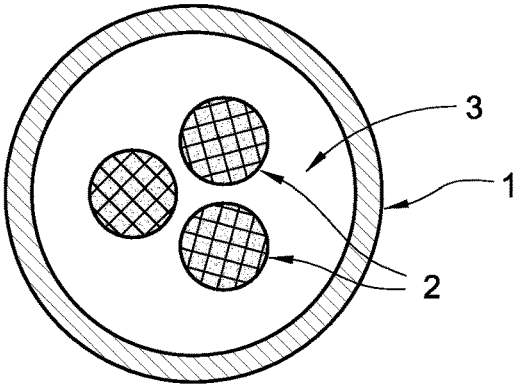
FIG. 4 is a transversal and cross-sectional view of a third preferred embodiment of this disclosure.

With reference to FIG. 4 for a heat pipe device in accordance with the third preferred embodiment of this disclosure, the third preferred embodiment is substantially the same as the first preferred embodiment except that the quantity of first capillary structures 2 of the third preferred embodiment is plural, and the first capillary structures are spaced apart from one another, and the external periphery of each first capillary structure 2 and the inner wall of the outer pipe 1 are spaced apart from each other without contact.

Figure 5:
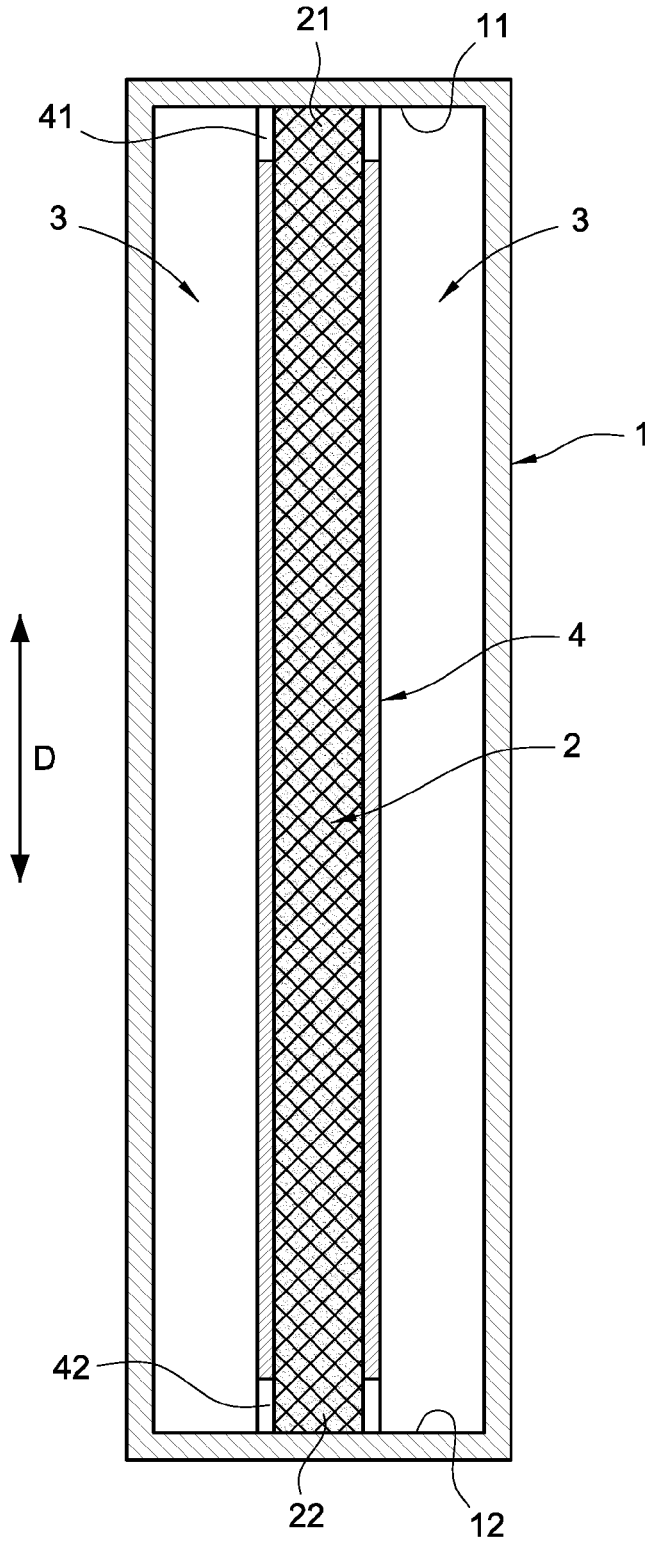
FIG. 5 is a longitudinal and cross-sectional view of a fourth preferred embodiment of this disclosure.

With reference to FIG. 5 for a heat pipe device in accordance with the fourth preferred embodiment of this disclosure, the fourth preferred embodiment is substantially the same as the first preferred embodiment except that the fourth preferred embodiment further comprises an inner pipe 4. The inner pipe 4 is wound around the first capillary structure 2, and both ends 21, 22 of the first capillary structure 2 are exposed from both ends of the inner pipe respectively, and the exposing method is not limited. In this preferred embodiment, both ends of the inner pipe 4 have at least one notch 41, 42, and both ends 21, 22 of the first capillary structure 2 are exposed form a notch 41 at an end of the inner pipe 4 and a notch 42 at the other end of the inner pipe 4 respectively, and the two exposed ends 21, 22 are communicated to the steam channel 3.

Figure 6:
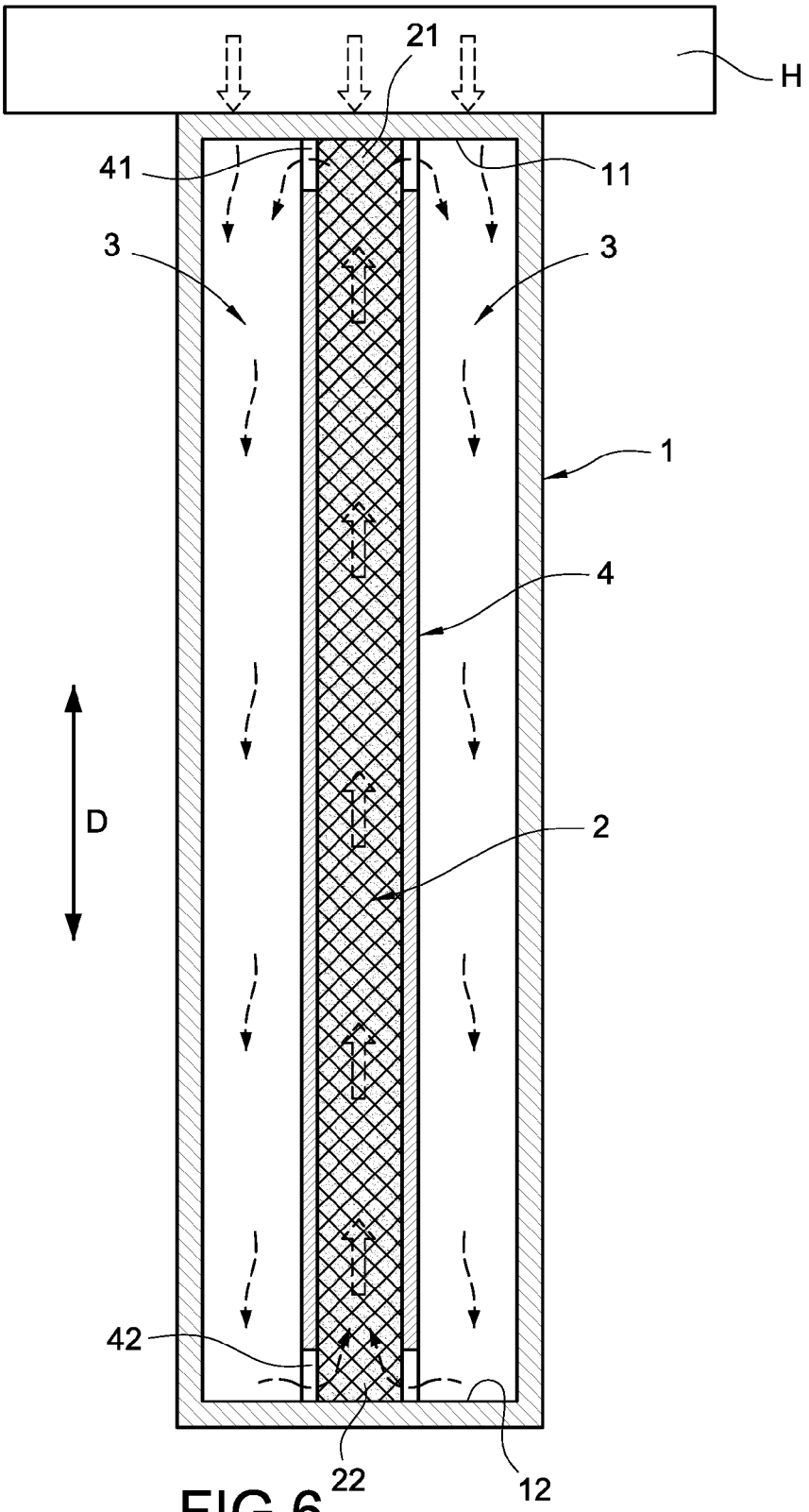
FIG. 6 is a schematic view of the flow of steam and water of this disclosure according to FIG. 5.

In FIG. 6, the heat pipe device in accordance with the fourth preferred embodiment of this disclosure has an upper end which is an evaporation end and a lower end which is a condensation end, so that any side (such as the top side as shown in FIG. 6 or a lateral side around the top side which is not shown in the figure) of the upper end of the heat pipe device of this disclosure is attached to a heat source H. When the working fluid inside the heat pipe device is evaporated by the heat of the heat source H, only the steam channel 3 is provided for flowing the steam, so that the steam is forced to flow from top to bottom of the steam channel 3 (as indicated by the dotted arrow which is opposite to the bottom-to-top direction). When the steam flows to the condensation end, the steam is condensed into water, and the water is passed from bottom to top and returned from the first capillary structure 2 to the evaporation end due to the pushing of the steam and the water suction effect of the first capillary structure 2 (as indicated by the hollow dotted arrow, which is opposite to direction of gravity or the top-to-bottom direction), and the water is heated to form the steam, and the cycle goes on and on.

However, the evaporation end and the condensation end of the heat pipe device of this disclosure are not limited to the configuration as shown in FIG. 6, and they can be used reversely. In other words, the upper end of the heat pipe device is the condensation end and the lower end of the heat pipe device is the evaporation end.

Figure 7:
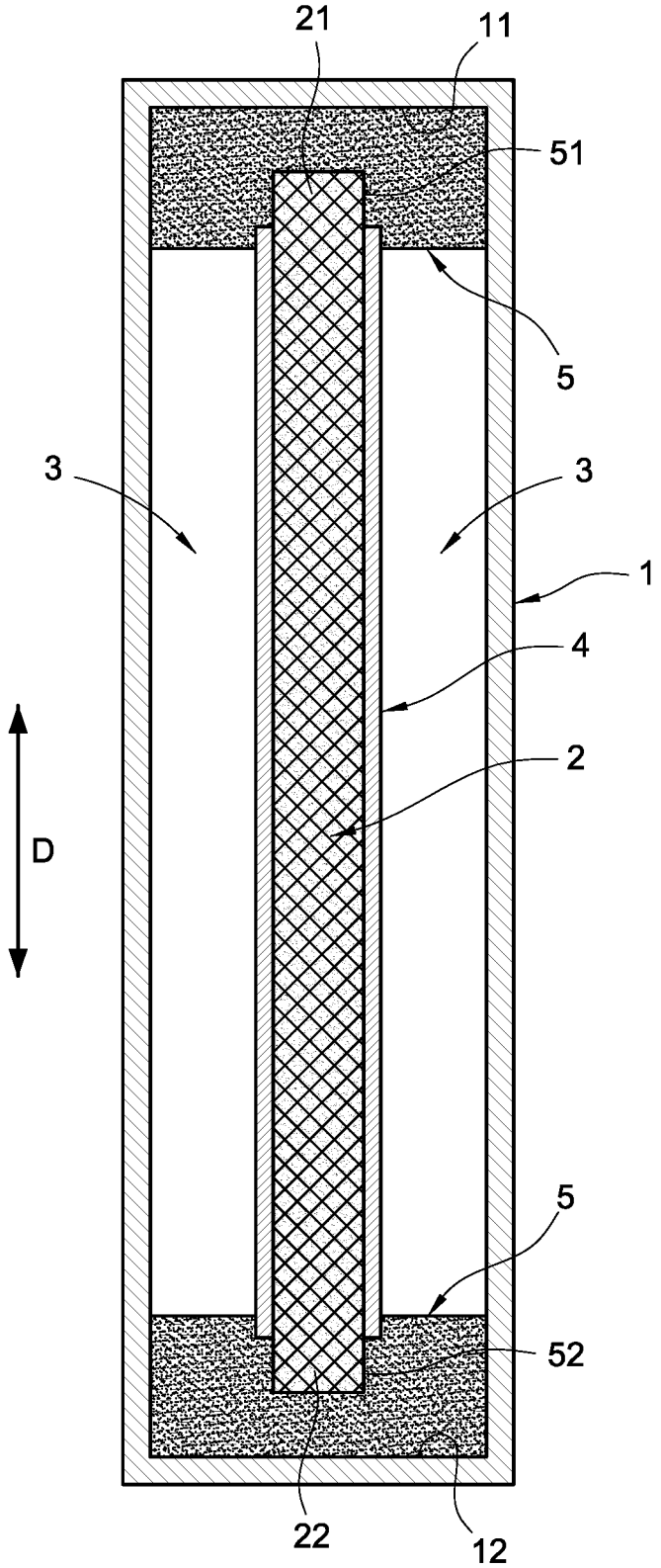
FIG. 7 is a longitudinal and cross-sectional view of a fifth preferred embodiment of this disclosure.
Figure 8:
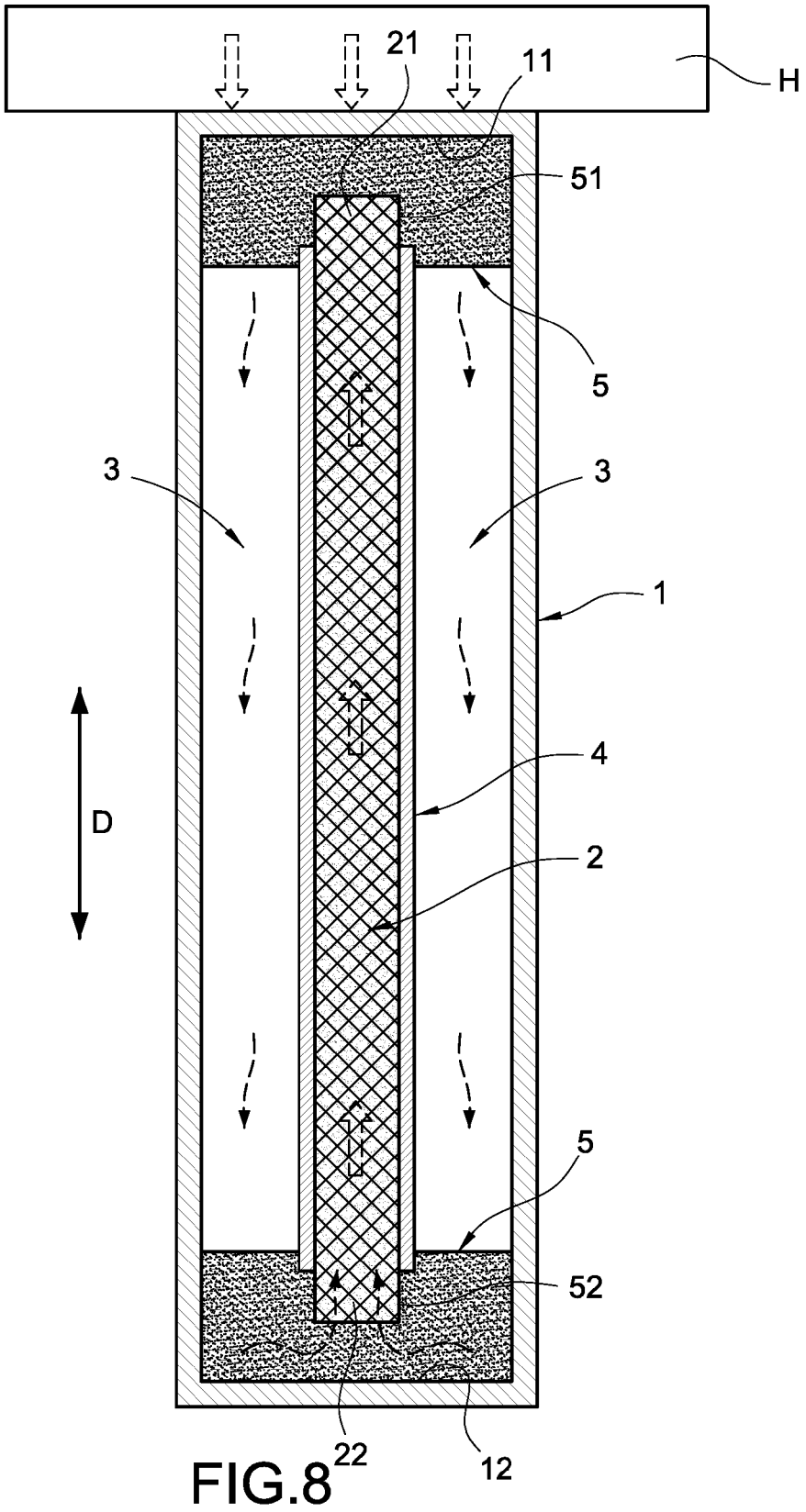
FIG. 8 is a schematic view of the flow of steam and water of this disclosure according to FIG. 7.

With reference to FIGS. 7 and 8 for a heat pipe device in accordance with the fifth preferred embodiment of this disclosure, the fifth preferred embodiment is substantially the same as the first preferred embodiment except that the fifth preferred embodiment further comprises an inner pipe 4 and the method of positioning the first capillary structure 2 is different, and this embodiment preferably comprises two second capillary structures 5.

The inner pipe 4 is wound around the first capillary structure 2, and both ends of the first capillary structure 2 are exposed from both ends of the inner pipe 4 respectively, and the exposing method is not limited. In this preferred embodiment, both ends 21, 22 of the first capillary structure 2 are protruded and exposed from both ends of the inner pipe 4. In other words, the length of the first capillary structure 2 is greater than the length of the inner pipe 4.

The two second capillary structures 5 is disposed (or filled) in the first inner end 11 and the second inner end 12 of the outer pipe 1, and both ends of the first capillary structure 2 are coupled and positioned at the two second capillary structures 5, but the positioning method is not limited. In this preferred embodiment, each second capillary structure 5 has a specific thickness to facilitate forming a recession 51, 52 on each end surface, and both ends 21, 22 of the first capillary structure 2 are plugged into the recessions 51, 52 of each second capillary structure 5 and positioned (wherein both ends 21, 22 of the first capillary structure 2 can be fully coupled to the second capillary structure 5), so that the first capillary structure 2 is coupled between and communicated to the two second capillary structures 5 and water can flow from the second capillary structure 5 at one end through the first capillary structure 2 to the second capillary structure 5 at the other end, and the steam channel 3 is formed between the inner pipe 4, the outer pipe 1 and the two second capillary structures 5, and both ends 21, 22 of the first capillary structure 2 are communicated to the steam channel 3 through the two second capillary structures 5 respectively.

With FIG. 8 for a heat pipe device in accordance with the fifth preferred embodiment of this disclosure, the heat pipe device has an upper end which is an evaporation end and a lower end which is a condensation end. When the working fluid in the heat pipe device is evaporated by the heat of a heat source H, just the steam channel 3 is provided for flowing the steam, so that the steam is forced to flow from top to bottom of the steam channel 3 (as indicated by the dotted arrow). When the steam flows to the condensation end, the steam in condensed into water, and the water is returned from the second capillary structure 5 at the lower end to the second capillary structure 5 at the upper end which is evaporation end (as indicated by the dotted arrow) due to the pushing of the steam and the water suction effect of the first and second capillary structures 2, 5 and then heated to form the steam, and the cycle goes on and on.

Figure 9:
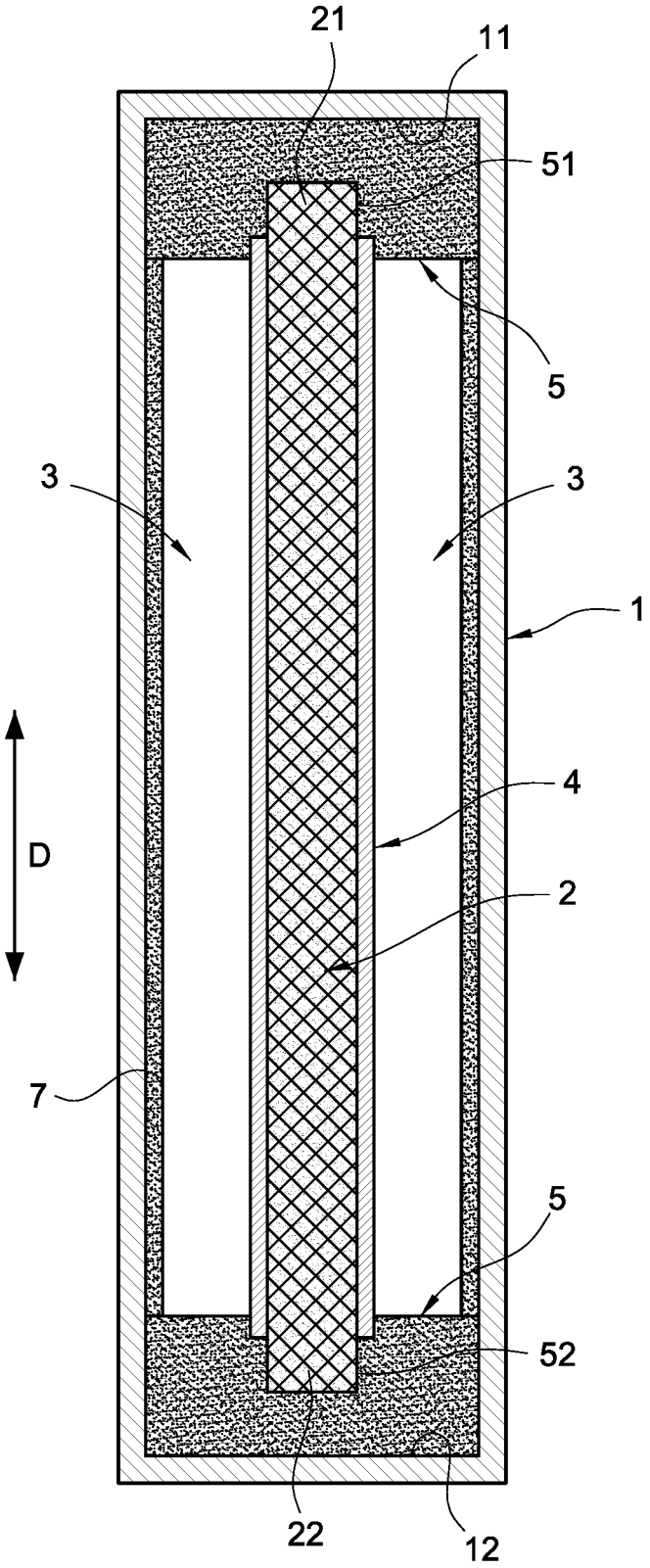
FIG. 9 is a longitudinal and cross-sectional view of a sixth preferred embodiment of this disclosure.

With reference to FIG. 9 for a heat pipe device in accordance with the sixth preferred embodiment of this disclosure, the sixth preferred embodiment is substantially the same as the fifth preferred embodiment except that the sixth preferred embodiment further comprises a third capillary structure 7. The third capillary structure 7 is disposed on the inner wall of the outer pipe 1 and coupled between the two second capillary structures 5 to assist the first capillary structure 2 (which is coupled between the two second capillary structures 5) to transmit water between both ends in the outer pipe 1, so as to achieve the effect of expediting the water transmission.

In addition, the fourth to sixth preferred embodiment of this disclosure may have the same effect as the first to third preferred embodiments, wherein the external periphery of the first capillary structure 2 and the inner wall of the outer pipe 1 are spaced from each other without contact (Refer to FIG. 2, but it is not necessarily limited to the middle of the outer pipe 1); or the external periphery of the first capillary structure 2 is partially contacted with the inner wall of the outer pipe 1 (as shown in FIG. 3); or the quantity of first capillary structures 2 and the quantity of inner pipes 4 are plural, and each inner pipe 4 is wound around each first capillary structure 2, and the inner pipes 4 are spaced apart without contact (as shown in FIG. 4). As to the second capillary structure 5 and the third capillary structure 7, they may be the same or different first capillary structures 2.

In summation of the description above, this disclosure improves over the prior art, so that the heat pipe device of this disclosure still can resist gravity and flows steam from top to bottom and water from bottom to top even in the upside-down condition, so as to achieve the effect of fitting the application of electronic devices without being limited by the using direction. In other words, the heat pipe device of this disclosure heat pipe device can be used in a forward direction (wherein the heat source H is disposed at the lower end of the heat pipe device, not shown in the figure) or in a reverse direction (wherein the heat source H is disposed at the upper end of the heat pipe device, as shown in FIGS. 6 and 8), so that the heat pipe device of this disclosure is not limited by the using direction.

In summation of the description above, this disclosure achieves the expected effects, overcomes the drawbacks of the prior art, and complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A heat pipe device, comprising:

an outer pipe, being a hollow pipe, and having a defined lengthwise direction;

at least one first capillary structure, accommodated along the lengthwise direction and positioned in the outer pipe, and at least one steam channel being formed along the lengthwise direction and between the at least one first capillary structure and the outer pipe;

two second capillary structures, both disposed in the outer pipe, and wherein two opposite ends of the at least one first capillary structure where the first of the two opposite ends being coupled to the first of the second capillary structures and the second of the two opposite ends being coupled to the second of the second capillary structures; and at least one inner pipe, wound around the at least one first capillary structure, and with one of the two opposite ends of the at least one first capillary structure being exposed from either end of the at least one inner pipe respectively and communicated to the at least one steam channel through the respective second capillary structures, two ends of the at least one inner pipe directly and respectively contacting the two second capillary structures.

2. The heat pipe device of claim 1, the outer pipe having a first inner end and a second inner end opposite to each other, and the two second capillary structures being disposed in the first inner end and the second inner end respectively.

3. The heat pipe device of claim 2, wherein each of the second capillary structures has at least one recess, and the two ends of the at least one first capillary structure are plugged into the at least one recess of each second capillary structure for positioning.

4. The heat pipe device of claim 2, wherein the two second capillary structures and the at least one first capillary structure are the same or different capillary structures.

5. The heat pipe device of claim 2, further comprising a third capillary structure disposed on an inner wall of the outer pipe and coupled between the two second capillary structures.

6. The heat pipe device of claim 2, wherein the at least one steam channel is formed between the outer pipe, the at least one inner pipe, and the two second capillary structures.

7. The heat pipe device of claim 1, wherein the external periphery of the at least one first capillary structure and the inner wall of the outer pipe are spaced apart from each other.

8. The heat pipe device of claim 1, wherein the at least one first capillary structure is a solid capillary structure.

9. The heat pipe device of claim 8, wherein the at least one first capillary structure is a powder sintered capillary structure or a bundled metal mesh capillary structure.

10. The heat pipe device of claim 1, wherein the first capillary structure and the inner pipe installed therein come with a plural quantity, and each of the inner pipes is wound around each the first capillary structure.

* * * * *